US007131552B2

(12) United States Patent
Simonson

(10) Patent No.: US 7,131,552 B2
(45) Date of Patent: Nov. 7, 2006

(54) COLLECTION ARRANGEMENT FOR A TRASH CONTAINER

(76) Inventor: Daniel J. Simonson, 220 Hill St., Riverton, WY (US) 82501

( * ) Notice: Subject to any disclaimer, the term of this patent is extended or adjusted under 35 U.S.C. 154(b) by 448 days.

(21) Appl. No.: 10/663,494

(22) Filed: Sep. 16, 2003

(65) Prior Publication Data

US 2005/0056649 A1 Mar. 17, 2005

(51) Int. Cl.
*B65D 35/14* (2006.01)
*B65D 6/08* (2006.01)

(52) U.S. Cl. ..... 220/495.06; 220/485

(58) Field of Classification Search ..... 220/495.06, 220/495.08, 495.11, 908, 908.1, 908.3; 248/99, 248/100, 101; 141/109, 338, 108; 15/257.1
See application file for complete search history.

(56) References Cited

U.S. PATENT DOCUMENTS 4,312,531 A * 1/1982 Cross ..... 294/55
4,357,728 A * 11/1982 Pravettone ..... 15/257.4
4,664,348 A * 5/1987 Corsaut et al. ..... 248/99
4,802,258 A * 2/1989 Jensen ..... 15/257.1
5,065,891 A * 11/1991 Casey ..... 220/495.08
5,803,300 A * 9/1998 DeMars ..... 220/495.11
6,052,860 A * 4/2000 Coxsey ..... 15/257.2
6,116,549 A * 9/2000 Santa Cruz et al. ..... 248/97
6,131,759 A * 10/2000 Young ..... 220/495.11
6,915,921 B1 * 7/2005 Mensch ..... 220/212

* cited by examiner

*Primary Examiner*—Jes F. Pascua
*Assistant Examiner*—Shawn M. Braden
(74) *Attorney, Agent, or Firm*—John O. Mingle

(57) ABSTRACT

The present invention provides an economically efficient trash collection arrangement for multiple use involving a sweeping ramp leading to a disposable, contained bag. In one configuration a special shaped container is provided as part of the arrangement, while in a further model the sweeping ramp is employed with a wide range of available containers.

2 Claims, 3 Drawing Sheets

COLLECTION ARRANGEMENT FOR A TRASH CONTAINER

BACKGROUND OF INVENTION

1. Field of Invention

The present invention relates to a collection arrangement for a trash container involving a ramp to provide easy sweeping of trash and debris into the container.

2. Background

Putting trash into containers is always an interesting challenge, and it is often more difficult by the use of standard sized plastic bags to hold and dispose of the trash. The trash location often further complicates the situation. Using such containers indoors usually involves the use of a dustpan and broom and further multiple dumping of the dustpan. When the trash is outside or in the garage, large containers are employed and the sweeping of leaves, dust and other debris often involves shovels and creating much lifting, even if a leaf rake is utilized.

The subject invention is design to make the collection of trash and debris, whether inside or outside, more easily accomplished by providing a sweeping ramp into the container that is laid on a relatively flat side. For further convenience containers are employed that utilize standard sized disposable plastic bags. In an alternate configuration only the sweeping ramp is employed and is designed to fit various sizes and shapes of existing containers.

Related United States patents include:

| U.S. Pat. No. | Inventor | Year |
|---|---|---|
| 4,802,258 | Jensen | 1989 |
| 5,065,891 | Casey | 1991 |
| 5,803,300 | DeMars | 1998 |

Referring to the above list, Jensen discloses a dustpan and guide with elaborate handle with matching flange design that serves as an attaching device and allows sweeping of debris into a conventional round trash container positioned horizontal. No mention of trash bags is made.

Casey discloses a complicated inner ring that holds trash receptacle liners in such a manner that trapped air toward the bottom of the receptacle is vented allowing the liner to fill more thoroughly.

DeMars discloses a moving mounting ring that holds a replaceable bag into a trash container in a manner that allows easy bag replacement.

SUMMARY OF INVENTION

The objectives of the present invention include overcoming the above-mentioned deficiencies in the prior art and providing a potentially economically efficient trash collection arrangement for multiple use involving a sweeping ramp leading to a disposable, contained bag.

DETAILED DESCRIPTION OF INVENTION

Figure 1:
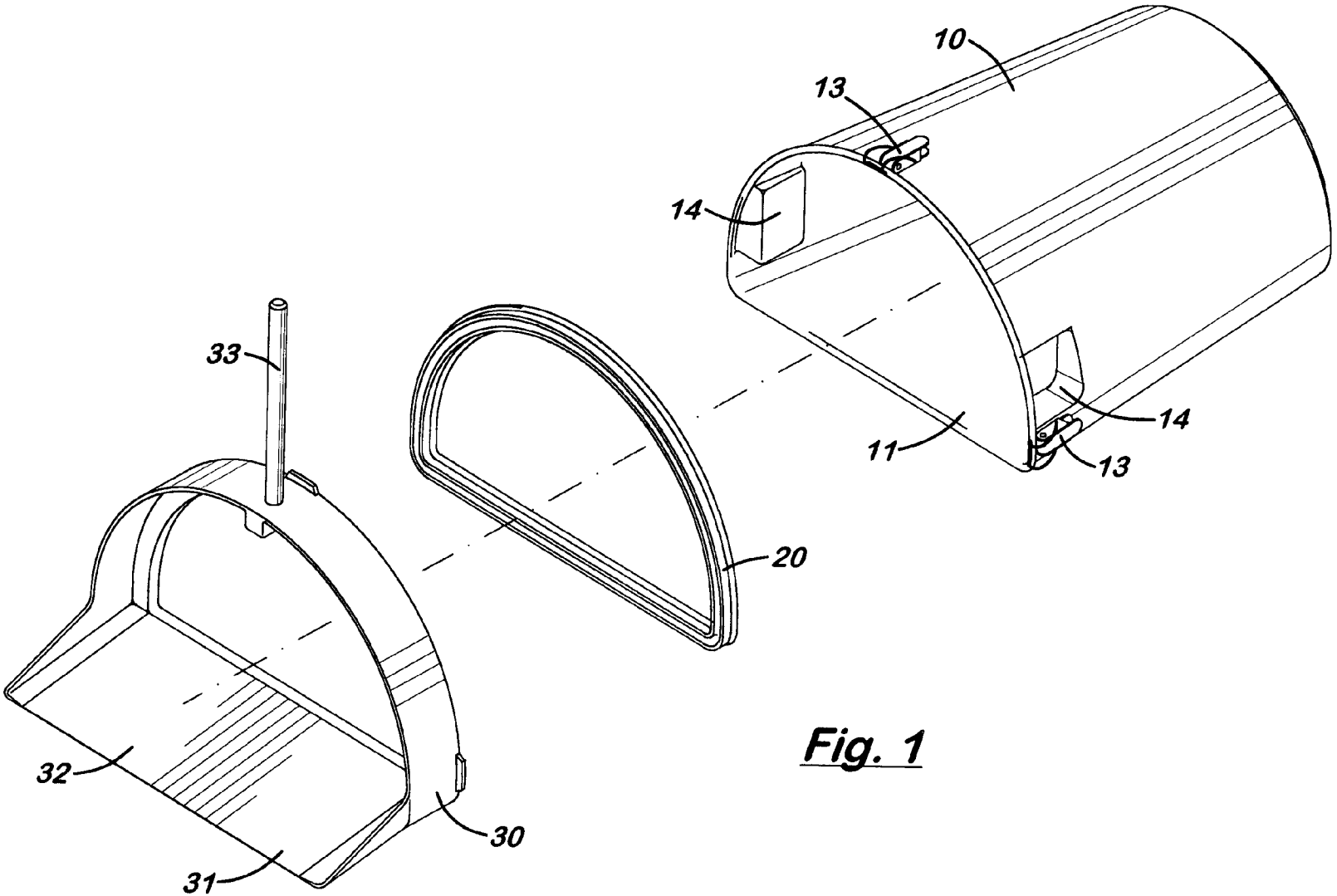
FIG. 1 shows an expanded view of a double wedge ring arrangement for attachment of the sweeping ramp to bag and container.

A collecting arrangement for a trash container is shown in four configurations in FIGS. 1–6. FIG. 1 shows an arrangement where a specially designed container is employed. The trash container 10 has a substantially flat side 11, conveniently obtained by employing a substantially semicircular container 10, and is stable either upright or lying on the flat side 11. Additionally the container 10 is sized for a standard replaceable trash bag, and potentially contains recessed handles 14 especially for larger sizes. The trash container 10, often made of plastic, may contain more than one flat side for many common such containers are routinely made in substantially square or rectangular shapes. Further it is convenient to place a pair of wheels on the outside bottom of said container particular for larger sizes, not shown in FIG. 1. The standard bag size varies from small sizes of 4 and 13 gallons that are common for house use to larger sizes of 20 through 39 gallons that are normally used for garages and outdoors; however, other sizes that become commonly available are also usable.

Figure 2:
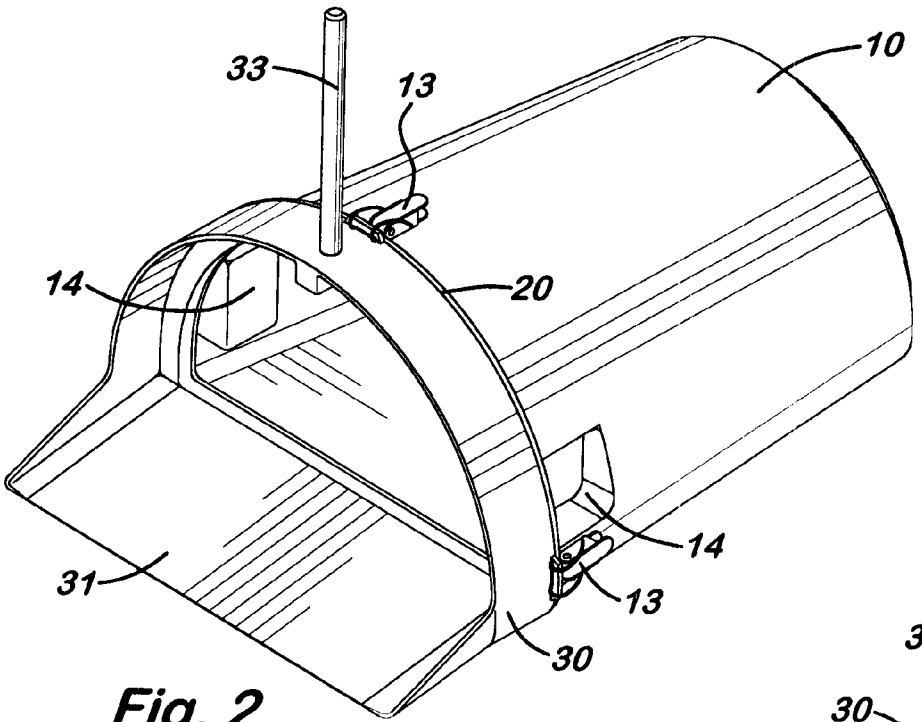
FIG. 2 shows the assembled parts from FIG. 1.
Figure 3:
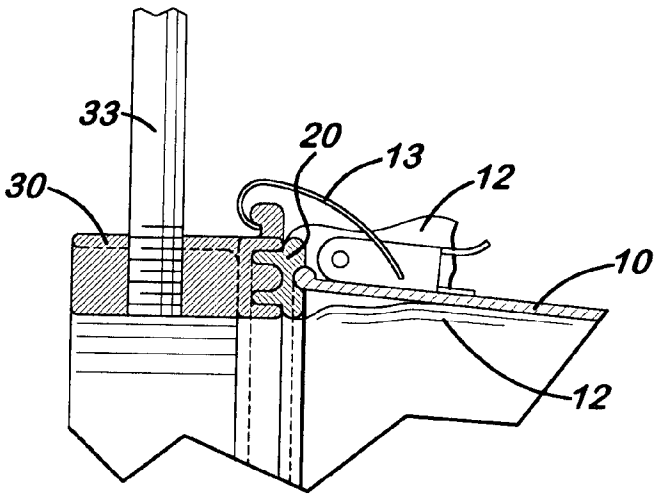
FIG. 3 shows a cross section of the double wedge ring attachment.
Figure 5:
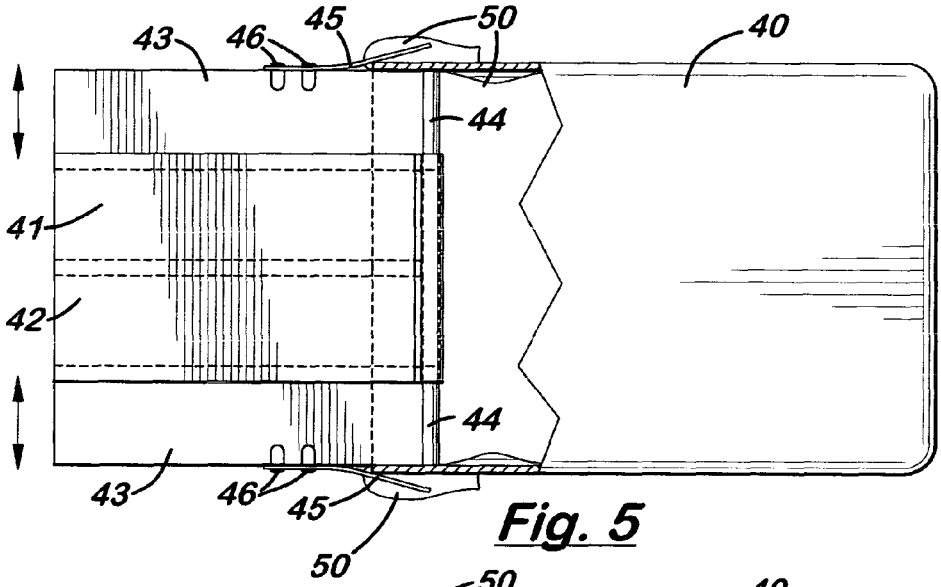
FIG. 5 shows an expandable sweeping ramp utilizing ramp side mounting spring clips.

The preferred means for attaching the bag to the container is shown in FIGS. 1–3. FIG. 1 shows an exploded view of the double wedge rings employed for such attachment, but the bag is not shown. The wedging is tight enough to hold the rings together but not so tight that they cannot be assembled and detached by hand. Ring 20 is wedged into ring 30, which contains the sweeping ramp 31, and such arrangement is shown in cross section in FIG. 3, which also shows the bag 12 attachment via ring 20 to ring 30. Thus the bag 12 is not attached to the container 10 allowing it to be removed along with the rings and utilized outside of said container for sweeping, especially with small container sizes. The sweeping ramp 31 composed of firm material 32 sized to fit into the top of said container is part of ring 30. Firm material 32 is identified as a good sweeping base in contrast to flimsy or excessively wavy material where sweeping is difficult. Multiple hasps 13 attach ring 30 to container 10. Often spring metal blades attached to the edges of the ramp 31 and extending over the trash container 10 edges are utilized; however, these are not shown in FIGS. 1–3 but are shown in FIG. 5 for a different configuration. The handle 33 as shown in FIGS. 1–3 is convenient in the shown location for smaller sizes of the trash container 10; however, for larger sizes such a handle is often placed on an edge of the ramp 31, but this is not shown in FIGS. 1–2.

Figure 4:
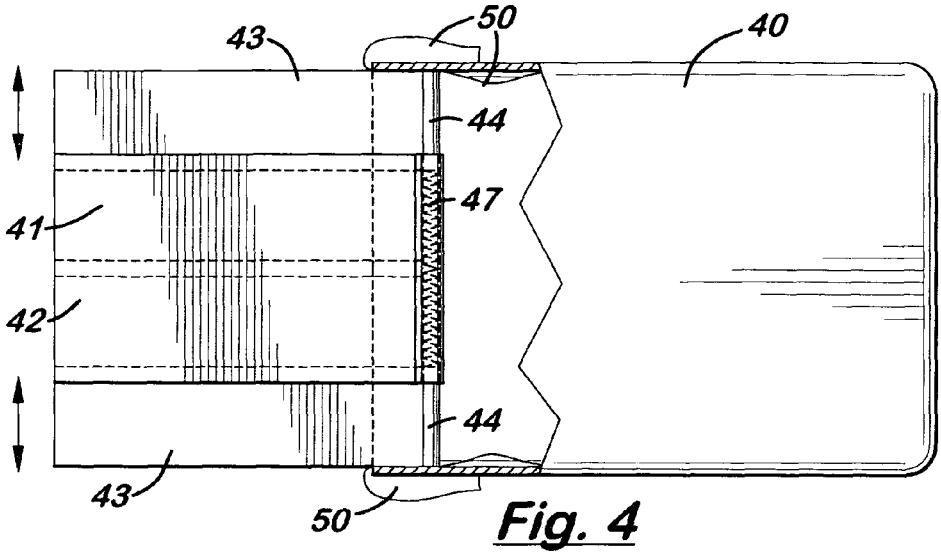
FIG. 4 shows an expandable sweeping ramp utilizing a spring-loaded attachment mechanism to a trash container.
Figure 6:
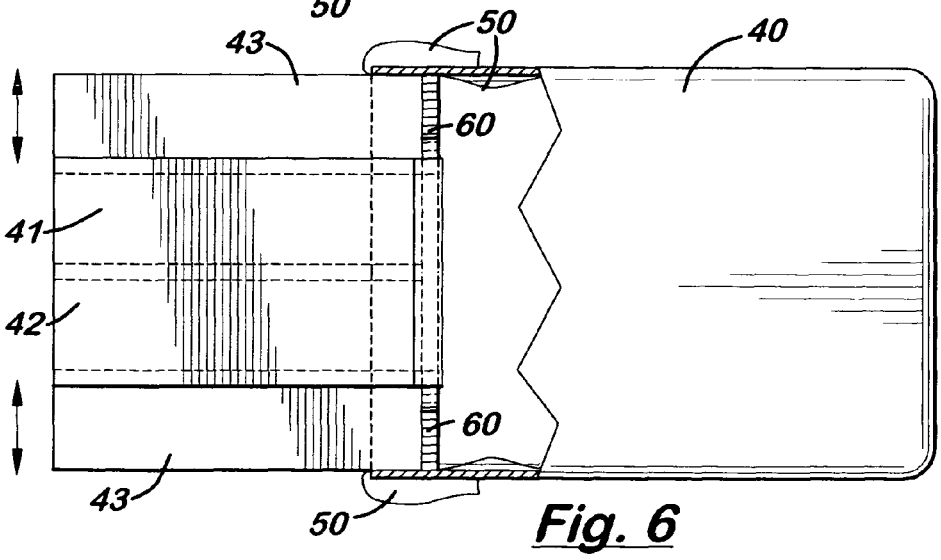
FIG. 6 shows an expandable sweeping ramp utilizing a pawl and ratchet mechanism.

An alternate collecting arrangement is shown in FIGS. 4–6 involving only the ramp part of the arrangement, for the container and its bag are separate as the ramp is designed to fit a number of sizes of containers; yet for completeness, the container and bag are shown in the figures. The container 40 surrounds a standard replaceable trash bag 50 that folds over the container top. A sweeping ramp 41 is composed of firm material 42. The ramp 41 is adjustable so as to fit into a variety of different sizes of trash containers 40 by means of altering the ramp 41 in width by overlapping material sections 43, which slide in or out so as to fit a number of sizes of standard trash containers 40 and yet allow an easily employed sweeping ramp 41. The mounting of the ramp 41 into the trash container 40 opening is shown in three potential manners in FIGS. 4–6. In FIG. 4 expandable bars 44 loaded with a spiral spring 47 are attached to the underside of the ramp 41 and are positioned to tightly fit against the inner side of said container 40 opening including the bag 50. Alternatively in FIG. 5 spring clips 45 are mounted 46 on the ramp 41 edges that press tightly against the outer side of the container 40 including the bag 50, and are convenient to hold the bag 50 into said container 40. In FIG. 6 one or more pawl and racket mechanisms 60 are employed on the top underside of said ramp 41 that hold the expanded ramp tightly as they contact the inner side of said container 40 opening including the bag 50.

A collecting arrangement for a trash container comprising a container for trash with a bag and with a side substantially flat so that said container is stable either upright or lying on the flat side, wherein the container is sized for a standard replaceable trash bag. The trash container, often made of plastic, may contain more than one flat side for many common such containers are routinely made in substantially square or rectangular shapes. Often a convenient shape is semicircular for the trash container. Further it is convenient to place a pair of wheels on the outside bottom of said container particular for larger sizes. The standard bag size varies from small sizes of 4 and 13 gallons that are common for house use to larger sizes of 20 through 39 gallons that are normally used for garages and outdoors.

A means for attaching the bag to the container so that trash fills the bag further comprises being selected from the group consisting of Velco straps, elastic bands, a series of clips, a wedged insert rings into the inside top of the container, and a hold-down connection. These are standard ways of keeping the bag within the container. The preferred method is the use of a wedged insert double ring which allows the bag to be attached between the rings so that all can be removed together along with the connected ramp and utilized outside of the container for sweeping especially with small container sizes.

A sweeping ramp composed of firm material is sized to fit into the top of the container along with means for attaching the ramp to the trash container, while lying on the flat side, so that trash swept onto and over the ramp flows into the bag. It is understood that referring to a sweeping ramp implies the use of a piece of hand-operated equipment, such as a broom, brush, or a leaf rake, that is not specifically identified herein. Firm material is identified as a good sweeping base in contrast to flimsy or excessively wavy material where sweeping is difficult. A number of common ways of attaching the ramp and container further comprise being selected from the group consisting of an insert ring sized to the top of said container employing multiple hasps, a handle attached to the side of said ramp, one or more spring metal blades attached to the edges of said ramp and extending over said trash container edges, and combinations thereof. The preferred method of an insert ring with connecting multiple hasps matches with the previous bag holding insert ring to allow the bag and ramp to move together. When a handle is employed it can be screwed into the ramp and utilized either by hand or by foot, the latter is particularly convenient when outdoors. When spring metal blades are employed, they conveniently hold the ramp to the container as well as the bag in place.

A collecting arrangement for a trash container, which surrounds a standard replaceable trash bag that normally folds over the container top, comprising a sweeping ramp composed of firm material with means for adjusting the ramp in width so as to fit into a variety of different sizes of trash containers, and means for mounting the ramp into said trash container opening, wherein the trash container is positioned on a side on a substantially flat plane so that the rear of the ramp significantly contacts a the plane, often a floor inside or the ground outside, allowing sweeping of the trash onto and over the ramp and into the trash bag within the container.

The means for adjusting said ramp in width further comprises construction with overlapping sliding material sections. These sections can slide in or out so as to fit a number of sizes of standard trash containers and yet allow an easily employed sweeping ramp.

The means for mounting the ramp into the trash container opening further comprises a number of potential methods. Spring-loaded expandable bars are attached to the underside of the upper ramp and are positioned to tightly fit against the inner side of the container opening including the bag, and these are conveniently blocked from completely coming apart. Alternatively spring clips are mounted on the upper ramp edges that press tightly against the outer side of the container including the bag, and are convenient to hold the bag into the container. A further method uses one or more pawl and racket mechanisms on the upper underside of the ramp that hold the expanded ramp tightly as they contact the sides of the container opening including the bag. Lifting the pawl allows the ramp to slide for removal.

The foregoing description of the specific embodiments will so fully reveal the general nature of the invention that others can, by applying current knowledge, readily modify and/or adapt for various applications such specific embodiments without departing from the generic concept, and therefore such adaptations or modifications are intended to be comprehended within the meaning and range of equivalents of the disclosed embodiments. It is to be understood that the phraseology or terminology herein is for the purpose of description and not of limitation.

I claim:

1. A collecting arrangement for a trash container which utilizes a standard replaceable trash bag, comprising:

a sweeping ramp composed of firm material, wherein said ramp consists of construction with overlapping sliding material sections allowing width adjustment so as to fit into a variety of different sizes of trash containers; and mounting said ramp into said trash container opening consists of spring-loaded expandable bars attached to the underside of said ramp that is positioned to tightly fit against the inner side of said container opening including the bag.

2. A collecting arrangement for a trash container which utilizes a standard replaceable trash bag, comprising:

a sweeping ramp composed of firm material, wherein said ramp consists of construction with overlapping sliding material sections allowing width adjustment so as to fit into a variety of different sizes of trash containers; and mounting said ramp into said trash container opening consists of one or more pawl and racket mechanisms on the top underside of said ramp that hold the expanded ramp tightly as they contact the sides of said container opening including the bag.

* * * * *